United States Patent [19]

Hannah

[11] Patent Number: 4,479,181

[45] **Date of Patent: * Oct. 23, 1984**

[54] ELECTRONIC CONTROL DEVICE FOR DECISIONS AND SCORING

[76] Inventor: James T. Hannah, 1 Cooinda Ct., Salisbury Heights, South Australia, 5158, Australia

[ * ] Notice: The portion of the term of this patent subsequent to Sep. 30, 1997 has been disclaimed.

[21] Appl. No.: 299,074

[22] Filed: Sep. 3, 1981

[30] Foreign Application Priority Data

Sep. 4, 1980 [AU] Australia ..... PE5416

[51] Int. Cl.[3] ..... G06F 15/44; G08B 23/00

[52] U.S. Cl. ..... 364/411; 273/1 ES; 377/5; 340/323 R

[58] Field of Search ..... 364/410, 411; 377/5; 273/1 E, 1 ES; 340/323 R

[56] References Cited

U.S. PATENT DOCUMENTS

| | | | |
|---|---|---|---|
| 3,737,889 | 6/1973 | Sweeny | 340/323 R |
| 3,959,640 | 5/1976 | Syria | 364/411 |
| 4,097,855 | 6/1978 | Salvo | 340/323 R |
| 4,119,838 | 10/1978 | Genuit | 340/323 R X |
| 4,223,383 | 9/1980 | Hannah | 364/411 |
| 4,237,372 | 12/1980 | Zevgolis et al. | 377/5 |

*Primary Examiner*—Jerry Smith
*Assistant Examiner*—Allen MacDonald
*Attorney, Agent, or Firm*—Pearne, Gordon, Sessions, McCoy, Granger & Tilberry

[57] ABSTRACT

An electronic device for decisions and scoring using a master and two slave controls to give a summation of at least two decisions characterized by digital logic to indicate to the referee the majority decision and when play should be stopped, initiating an audible signal.

9 Claims, 3 Drawing Figures

ELECTRONIC CONTROL DEVICE FOR DECISIONS AND SCORING

BACKGROUND OF THE INVENTION

According to an earlier invention of mine for which a patent application accompanied by a complete specification No. 40325 of 1978 was filed in relation to an electronic device for scoring and in particular and particularly to a device designed to take uncertainty out of decisions in the game of squash, although applicable with some modification to tennis and other games, it was explained that one of the reasons for the device was that world tournaments are being conducted which have extremely high prize money and therefore need a system of scoring which will ensure that the players can depend on the decision which is called, and while, for instance, the rules of squash as approved by the International Squash Racquet Federation allows for the control of the game by one referee and one marker, it was proposed according to that invention that control be by one marker and by three referees, that is, by an odd number of persons, so that a decision recorded is the result of, for instance, two out of three decisions.

A corresponding application in the United States of America has been issued as U.S. Pat. No. 4,223,383 on Sept. 16th, 1980.

The object of the invention was to ensure during scoring that the decision of more than one person will be available and the final decision will be a majority decision and the object of the invention therefore is to provide a device which will allow this to be effectively achieved.

The invention described a device which has at least three decision units and one read-out unit, the decision units each being provided with the necessary press buttons by means of which a decision can be recorded, and the read-out unit being provided with indicators, such as lights, which show the result of all or any two of the decision units.

Thus in relation to the game of squash the three decision units could have seven buttons each, a central button recording a point, two buttons recording either a LET or NO LET, two buttons scoring either UP or NOT UP, and two buttons scoring either IN or OUT.

Each of these decision units could be held by persons at different vantage points and each of these units was coupled electrically to an electronic device which recorded only that decision which is given by two of the three persons, one of whom can be the referee or MASTER.

Thus the referee or MASTER for the game can as well as acting in a normal manner to call the decision be reinforced by two persons simultaneously also recording the decision as they see it, and as the device will then indicate the decision recorded by all or at least two of these persons, a highly effective check is given on the referee's decision thus greatly reducing errors which could occur when a single referee is used.

While the decision units were described as having a series of buttons it was pointed out that this would vary according to the game to which the invention is applied, but the basic principle was that at least three persons record their vote but the final decision was the result of any two of the three parties.

The read-out was conveniently arranged to show the recording of a point at the center of a display board with positive indicators to one side and negative indicators to the other side so that in the case of squash UP, IN, LET, were on one side of the STROKE indicator, while the NO LET, OUT,and NOT UP were on the other side.

OBJECT OF THE INVENTION

It has now been found that the device described in my U.S. Pat. No. 4,223,383 had a defect in that while lights were used to show a decision, if the referee failed to see an OUT or a NOT UP on, play could go on with considerable wastage of time and effort and the present invention seeks to eliminate this problem.

SUMMARY OF THE INVENTION

I have found the answer in providing an audible signal and its associated circuitry which is energized each time the OUT or NOT UP indicator is energized, and the present invention relates to apparatus including this added signal. It also includes a voltage indicator to ensure correctness of the signal.

The invention thus comprises an electronic device for decisions and scoring comprising at least three control boxes, each having designated decision members each switchable between two logic states by a person to indicate a decision or score, an indicator panel having energizable indicator means designed to correspond to the decision members and remote from at least two of the control boxes, audible indicator means connected to the indicator panel, and electronic digital logic circuitry between the decision members in the control boxes and the energizable indicator means in the panel, the digital logic circuitry being arranged to actuate the indicator means when similarly designated decision members situated in at least two separate control boxes are actuated to establish a predetermined logic pattern whereby the indicator means indicates the logic pattern of such actuated decision members, and the audible indicator means are actuated when a selected condition of said logic pattern occurs.

DESCRIPTION OF PREFERRED EMBODIMENT

Figure 1:
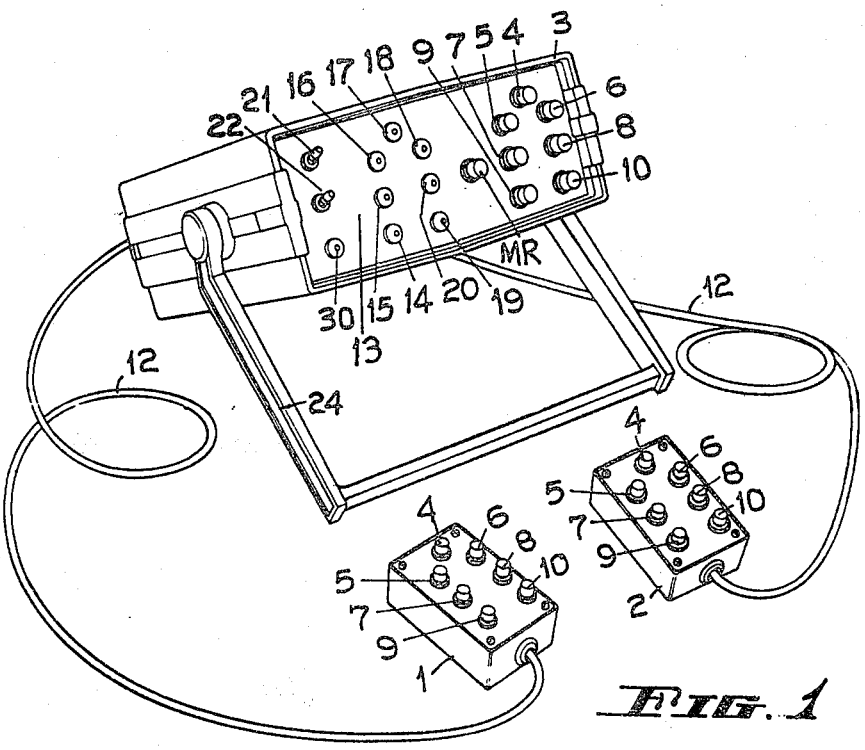
FIG. 1 is a front perspective view of the invention.

The system entails each of three persons having a control box marked respectively 1, 2, and 3, each with seven push button switches 4, 5, 6, 7, 8, 9 and 10, marked—STROKE, LET, NO LET, UP, NOT UP, IN and OUT respectively.

Two of the control boxes 1 and 2 are connected by cables 12 to the electronic circuitry of the third control box 3 which includes an indicator panel 13 and carries the electronic components including the summing electronics.

In the form described in my U.S. Pat. No. 4,223,383 which does not have a "hold" circuit, the electronic circuitry is arranged so that if two or three persons make the same decision, that decision is indicated on the indicator panel 12 for as long as any two of the buttons 4 to 10 are pressed. The circuit is so arranged that, in the case of no decision, a LET is indicated. In the case of a person being unable to reach a decision, or through being unsighted, the LET button will be pressed by him.

Figure 2:
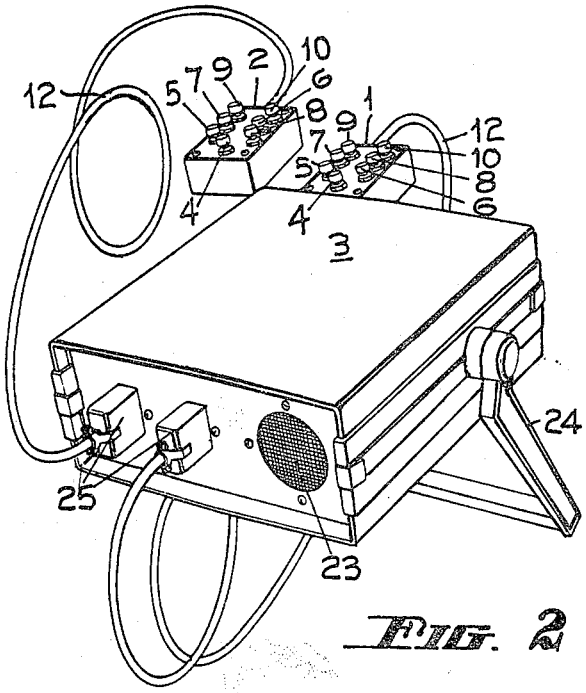
FIG. 2 is a rear perspective view.

The electronic circuitry illustrated in FIG. 2 of my prior U.S. Pat. No. 4,223,383 consists of CMOS microcircuits switching LED indicators 14, 15, 16, 17, 18, 19 and 20 actuated via switching transistors S, and the power supply was by dry cells or any suitable power source.

The electronics and batteries were fitted into a case for ready portability, and this could also hold the indicator panel 12. It was suggested that the marker's display and scoreboard could be packed into a pouch in the lid of the case, and the case could also removably carry the three control boxes.

The electronic circuitry was described as having appropriate indicator lights 14 to 20 energized only when, and so long as, at least no similarly defined push buttons 4 to 10 were held down, that is, for instance the UP push buttons 7 in boxes 1 and 2 or 1 and 3 or 2 and 3 signifying that at least two persons are in agreement.

A series of push buttons operating recording switches were positioned in the boxes 1, 2, and3, but AND gates controlled thereby were indicated by the letters a, b and c, with the numeral prefixes 1, 2, 3, 6, 7, 8 and 11 to represent respectively NO LET, STROKE,UP, NOT UP, OUT, IN and LET, the circuit including OR gates also having the letters a, b and c applied thereto but with the prefixes 4, 5, 9, 10, 12, 13, 14 and 15.

All gate inputs were held down by resistors R to $O_v$ so that assigning any switch to the positive line put logic "1" on the associated gate input.

The NO LET switches were respective switches on the three control boxes 1, 2 and 3, and a combination of any two of these switches resulted in one of the two input AND gates 1*a*, 1*b* or 1*c* put a logic "1 " on one input of the specific OR gate 4*a*, thus switching on a transistor associated with that gate and lighting the NO LET indicator light 18.

Similar circuits are associated with the STROKE, UP, NOT UP, IN, OUT and LET switches—except that the LET circuit includes an additional OR gate 15*a* fed by the OR gates 5*a*, 5*b*, 5*c*, 10*a*, 10*b*, 10*c* operating through the AND gates 14*a*, 14*b* and 14*c*. The NO LET circuit was opened by any one switch being made.

The specification of my earlier U.S. Pat. No. 4,223,383 teaches that the OR gates 5*a*, 5*b* and 12*b* associated with NO LET, STROKE and LET switches are associated with put logic "1" on one input of the AND gate 14*a*, as did also any one STROKE or any one LET switch. Thus if one NO LET, one STROKE and one LET switch are pressed together this put logic "1" on an input of the OR gate 15*a* to energize the LET indicator 16.

Similar action resulted with the combination of one LET, one NOT UP and one UP switch via 14*b*, or with the combination of one IN, one OUT and one LET switch via 14*c*.

Thus there was a primary circuit and a secondary circuit for each indicator, the primary circuit being controlled by three similar push buttons in each of the control boxes 1, 2 and 3 which circuit comprises, for instance, the NO LET three AND gates 1*a*, 1*b* and 1*c* to each of which two push buttons are connected, and these were summed by an OR gate which then controlled the switching transistor S to actuate the light 16 when at least two buttons actuate the AND gates 14*a*, 14*b*, 14*c* and the summation of these through the OR gate 15*a*.

A secondary circuit to the OR gate 5*a* receives a signal from each of the push buttons and was connected through the LET circuit AND gate 14*a* and through the OR gate 15*a* to the switching transistor S to the light 16, signals from the OR gates 5*b*, 5*c*, 10*a*, 10*b*, 10*c* and 12*b* similarly feeding through the AND gates 14*a*, 14*b*, 14*c* and the summation of these through the OR gate 15*a*.

Figure 3:
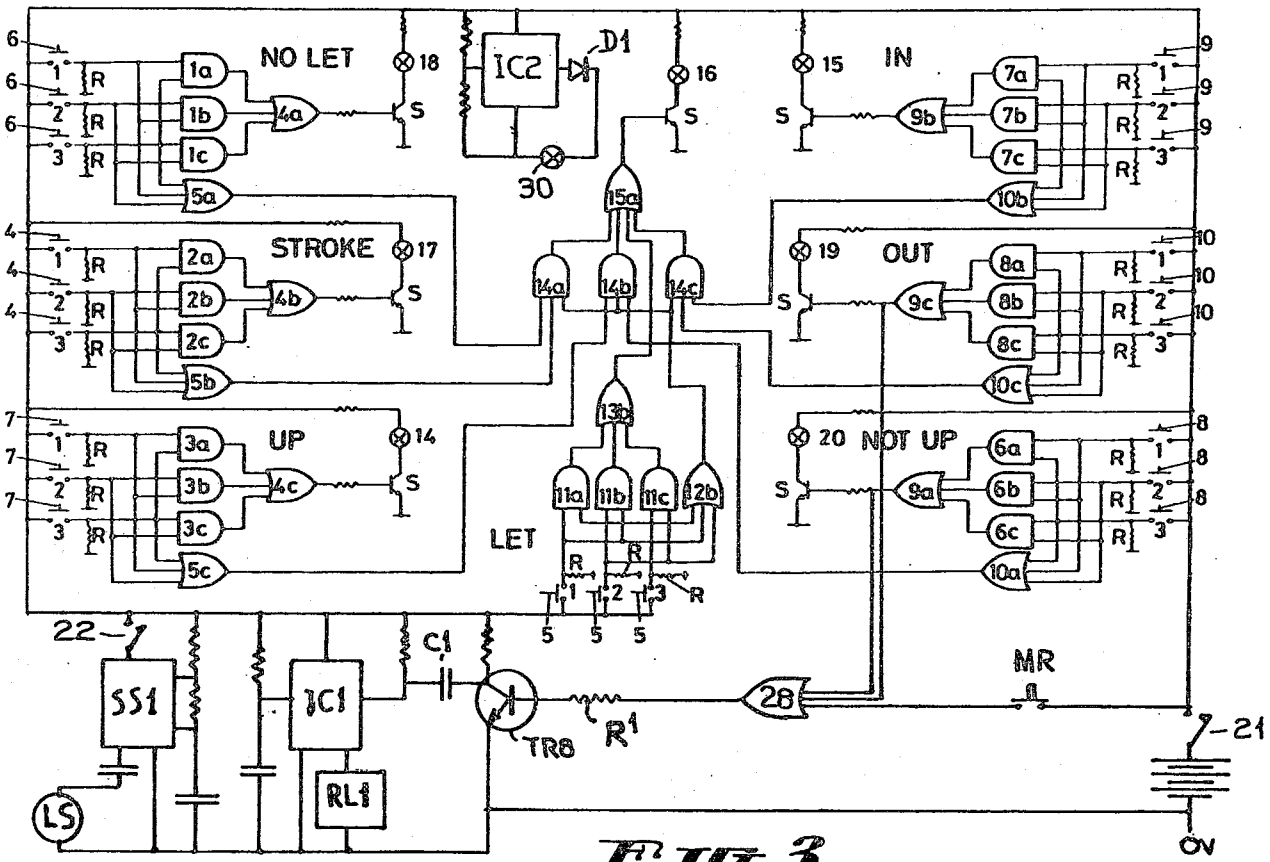
FIG. 3 shows the circuit diagram.

A further refinement of the basic Refereeing set was a facility to latch the outputs to the marker's display for a period of N seconds, the drawing of which was designated FIG. 3 in my U.S. Pat. No. 4,223,383.

The circuit remains the same as far as the suming inputs (two out of three) are concerned, but the outputs of 4*a*, 4*b* and 4*c*, 15*a* and 9*a*, 9*b* and 9*c* were connected via diodes to the input of a monostable multivibrator and also wait directly via individual latches of two Quad-latches. The monostable had a period of perhaps five seconds.

Upon any one decision being made, the monostable went to "1" and the output went positive for N seconds, determined by the time constant of a control resistor and condenser.

A further facility, if required, was for the decision lines to be taken to a scoreboard for spectator presentation.

Generally it was not advisable to latch in the seven individual decisions but the facility could be used if required.

With reference to FIGS. 1–3 of the present specification, the invention comprises the aforesaid control boxes 1, 2 and 3, the control boxes 1 and 2 having the various scoring buttons 4, 5, 6, 7, 8, 9 and 10 indicating respectively STROKE, LET, NO LET, UP, NOT UP, IN and OUT.

The larger control box 3 also includes the various indicator lights 14, 15, 16, 17, 18, 19 and 20 arranged for convenience in the same order, and includes the necessary energizing switches 21 and 22 for the circuitry.

The audible signalling device is housed behind the window 23.

The handle 24 allows the box 3 to be conveniently positioned on a support surface. Plugs 25 terminate the cables 12 in sockets in the box 3.

In the arrangement illustrated the MASTER unit control box 3 carries the electronic mechanism and power supply as well as the buttons 4 to 10 of the recording switches, and the slave control boxes 1 and 2 are connected by cables to the master control box 3. The control box 3 could however be separate from the indicator panel as in the earlier embodiment.

The present invention adds an appropriate OR gate 28 (see FIG. 3) connected to the OUT AND gate 9*c* and NOT UP AND gate 9*a* so that when either of these circuits is energized an amplifier will then be caused through appropriate circuitry to energize a loudspeaker or similar audio device arranged to give a signal at sufficient intensity to call to the notice of the MASTER referee that an OUT or NOT UP has been indicated, thus immediately stopping play.

The circuit basically comprises an OR gate 28 which receives the signal from the OUT and NOTUP circuits and passes it to a transistor TR8 through a resistor R1 from which it is fed by a condenser C1 to the input of an integrated circuit amplifier IC1 which actuates a solid state switch SS1 through a relay RL1 to energize a loudspeaker LS or other audio device such as a buzzer, a hold circuit being included to regulate the time during which the loudspeaker or audio device is actuated. A switch MR is shown which allows the referee or MASTER to energize the audio signal manually at will.

A battery voltage indicator is added to the board to ensure that the various gates and devices are held at correct potential to ensure that there is no failure of the system due to low voltage, and this can again use an integrated circuit IC2 set to actuate an indicator light 30 through a diode D1 well before a significant voltage drop occurs.

From the foregoing it will be realized that according to the general system described, using the three referee system, one of these three must be installed as the MASTER. The other two qualified persons are simply monitors for any decision on appeal by one of the contestants.

The establishment of the MASTER is imperative because in the game of squash only the master has the right to stop play to warn a player or both players that they are in some way infringing rules of the game which is detrimental to the general concept and sportsmanship of the event in play. According to the old electronic system illustrated in my U.S. Pat. No 4,223,383 the only provision where play can be stopped by a majority decision was during a rally two referees deciding a shot was NOT UP or further a ball was out of court, and to push the appropriate button i.e. NOT UP or OUT, this then actuated a light on the MASTER'S board and, when seen by the MASTER, the MASTER would stop play, announce the decision, and the marker would score accordingly.

In an instance where the MASTER in this situation has not noticed the NOT UP or OUT but the two monitors have pushed the appropriate button, the MASTER being intent on the concentration of watching play does not notice the decision light is on and play continues for any length of time until the rally is won and if won by the infringing player the opponent can appeal that a ball played previously was in fact NOT UP or OUT. Obviously the opponent would win the appeal, but the fact that play continued after the infringement is detrimental. The two monitors having pushed the correct button but are in no position to see the light hold their button for 3–5 seconds and then independently feel that they are alone in assuming what occurred and therefore release their button and so no further light is energized.

With the modification of the system to that now described this problem is removed because when any two NOT UP and OUT buttons are pressed, an audible signal will sound, and the MASTER'S board also registers the appropriate light to the decision in the group on the MASTER'S board. Then the MASTER simply looks at the board and calls it immediately, there can be no appeal by the player, as obviously a majority decision has been registered. The play has stopped instantly and this is in the best interests of the players.

According to a modification the unit can be used in a two referee situation by putting number 3 referee ona permanent LET, then if the other two do not agree LET is played. Whilst not being as desirable as the three referee system it is still at times more acceptable than one referee because the unanimous decision of the two is necessary.

The device will also be found to be useful in televised coverage of sport where the decision of an umpire or referee can be shown in many cases to be wrong because the television cameras recorded the actual play sometimes from a better vantage point than the referee or umpire has and when a device according to this invention is in use, the advantage will exist not only that it is a majority decision which is being recorded, which itself will greatly reduce error, but the decision also is recorded on different vantage points as the main referee or umpire may have his usual position in relation to the game but the two other persons can be in advantageous positions where they can better interpret the decision with certain stokes and angles.

I claim:

1. An electronic device for decisions and scoring comprising at least three control boxes, each having designated decision members each switchable between two logic states by a person to indicate a decision or score, an indicator panel forming part of one of said boxes having energizable indicator means designed to correspond to the decision members, audible indicator means connected to the said indicator panel, and electronic digital logic circuitry means between the decision members in the control boxes and the energizable indicator means in the panel, the digital logic circuitry means being arranged to actuate the indicator means when similarly designated decision members situated in at least two separate control boxes are actuated to establish a predetermined logic pattern in the said logic circuitry means whereby the indicator means indicates the logic pattern of such actuated decision members, and the audible indicator means being arranged to be actuated when a selected condition of said logic pattern occurs.

2. An electronic device according to claim 1 characterized in that three control boxes are used and two of the said control boxes are remote from the said third box and are connected by cable means to the said third control box, and the said third control box carries the said digital logic circuitry means and the said indicator panel to form a MASTER unit.

3. An electronic device according to claim 2 characterized in that the said audible indicator means are also carried by the said MASTER unit.

4. An electronic device according to claim 2 characterized in that the said MASTER unit comprises a box having a front panel, push buttons on the said panel connected to actuate the said switchable decision members, and a series of lights forming the said energizable indicator means also on said panel, said MASTER unit incorporating the said audible indicator means.

5. An electronic device according to claim 4 characterized in that the said MASTER unit and the said remote units have the said decision members arranged in corresponding positions the one to each other and in that the said energizable indicator means are arranged in corresponding positions the one to each other.

6. An electronic device according to claim 4 characterized in that the said box of the MASTER unit has a handle pivoted to the box to extend therefrom to allow the box to be supported in a tilted position, and by means to connect electrical transmission cables from each to the said remote boxes.

7. An electronic device according to claim 1 arranged as a scoring device for the game of squash having the said decision members on each box identified as STROKE, LET, NO LET, UP, NOT UP, IN and OUT, and in that the said audible alarm is actuated when either the OUT or the NOT up decision members are actuated.

8. An electronic device according to claim 1 characterized in that the said audible indicator means comprise an OR gate connected to be triggered by a signal from selected decision members and connected to initiate a relay in turn connected to impress an audible signal on a loud speaker.

9. An electronic device according to claim 8 characterized by a manual switch connected to also trigger the said OR gate.

* * * * *